United States Patent [19]

Thompson

[11] 4,197,878

[45] Apr. 15, 1980

[54] HYDRAULIC VALVE

[75] Inventor: Vern C. Thompson, Minneapolis, Minn.

[73] Assignee: Ideus, Inc., Edina, Minn.

[21] Appl. No.: 891,688

[22] Filed: Mar. 30, 1978

[51] Int. Cl.[2] ..... F15B 13/042

[52] U.S. Cl. ..... 137/625.66; 137/625.6; 137/625.63; 91/52

[58] Field of Search ..... 137/625.6, 625.61, 625.62, 137/625.63, 625.64, 625.66; 91/52

[56] References Cited

U.S. PATENT DOCUMENTS

| | | | |
|---|---|---|---|
| 3,135,294 | 6/1964 | Huber | 137/625.61 |
| 3,862,643 | 1/1975 | De Zelan et al. | 137/625.63 |
| 3,949,645 | 4/1976 | Masclet | 137/625.66 X |
| 4,044,795 | 8/1977 | Tardy et al. | 137/625.6 |

FOREIGN PATENT DOCUMENTS

| | | | |
|---|---|---|---|
| 189654 | 11/1966 | U.S.S.R. | 137/625.64 |

*Primary Examiner*—Gerald A. Michalsky
*Attorney, Agent, or Firm*—H. Dale Palmatier

[57] ABSTRACT

A hydraulic fluid spool valve having a bore in the housing and a stationary rod centrally through the bore; a hollow valve spool in the bore and embracing the rod, the spool having main lands and grooves engaging the bore periphery for variously connecting and obstructing fluid passages intersecting with the bore, the spool having control lands at its opposite ends minutely spaced from the bore periphery, and defining band orifices allowing continuous flow of hydraulic oil, and passages at the ends of the bore supplying control hydraulic fluid into the bore, and dual end-to-end springs within the hollow spool, anchored on the rod and also anchored to the spool to return the spool to centered rest position.

5 Claims, 9 Drawing Figures

FIG. 1
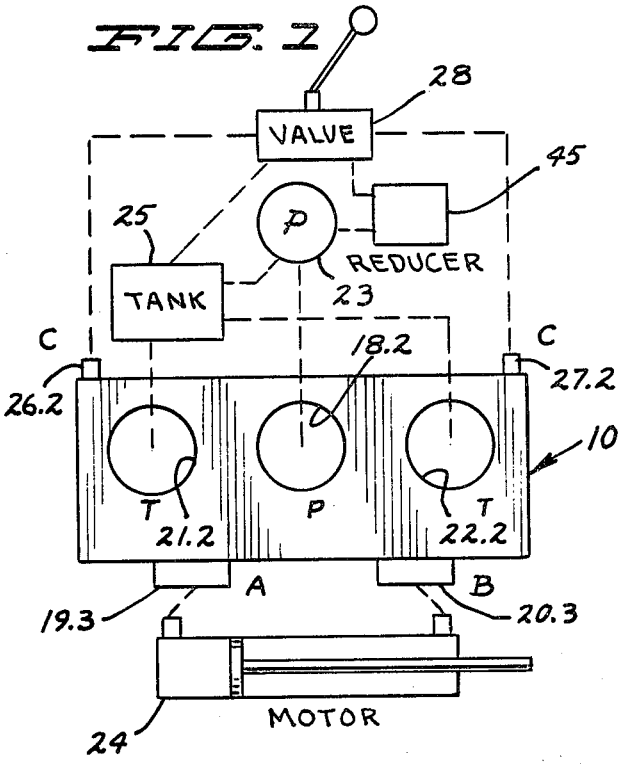
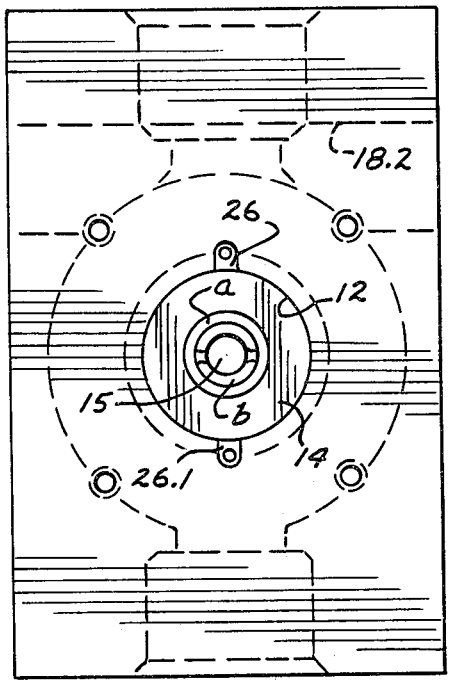
FIG. 3
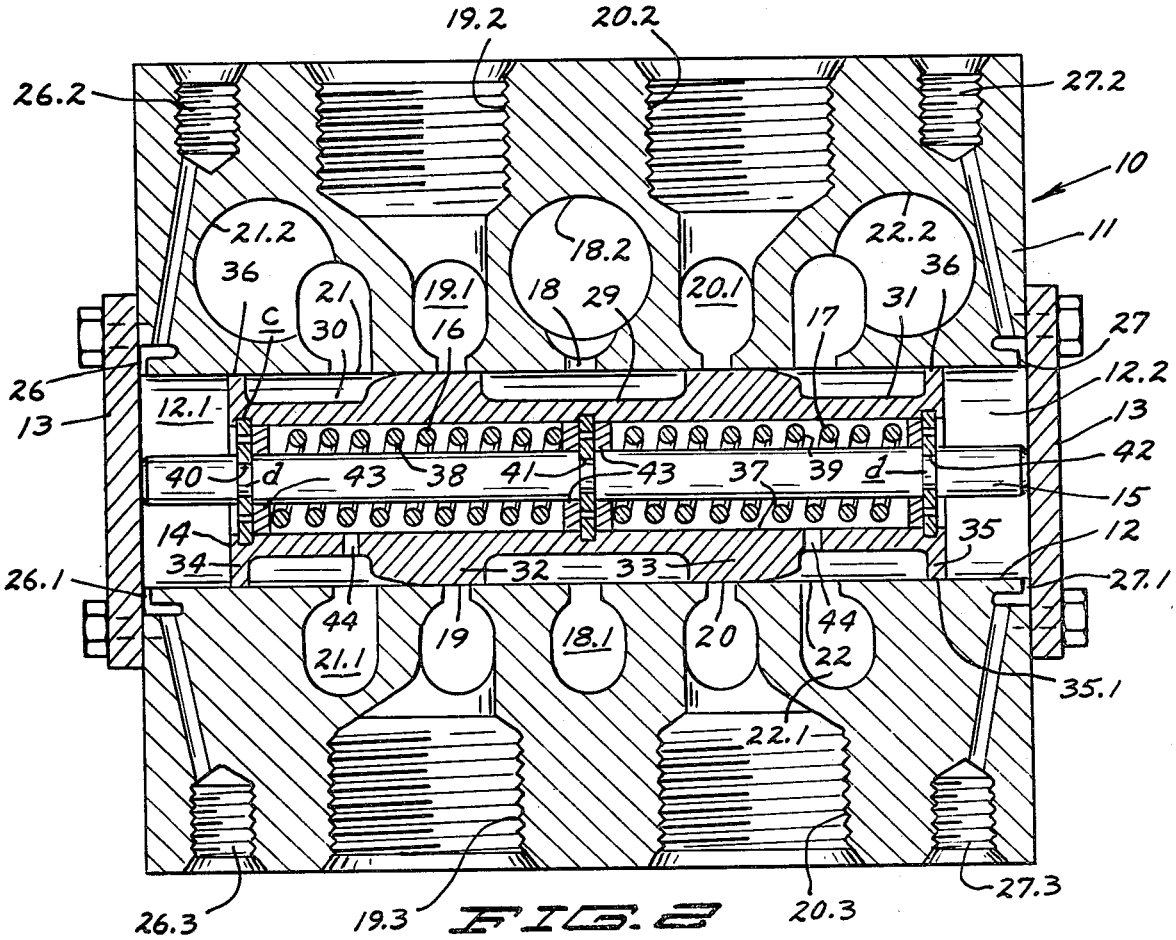
FIG. 2

HYDRAULIC VALVE

This invention relates to a fluid valve wherein the main fluid passages are alternately opened and closed with respect to each other and are controlled by a pilot fluid circuit.

BACKGROUND OF THE INVENTION

These types of fluid valves are often referred to as spool valves because they incorporate a spool-shaped armature or piston which moves endwise in the valve housing and has a number of grooves and lands at its periphery for variously connecting the main passages of the valve.

Such spool valves are especially useful in valving hydraulic liquids such as hydraulic oil, but are also useful in valving gaseous fluids. Where herein reference is made to fluids or hydraulic oils or liquids, it should be understood that the language may also be extended to compressible or elastic gaseous fluids.

Valving hydraulic oils for operating motors such as hydraulic cylinders with moving pistons, presents a wide variety of problems under widely varying circumstances. Fluid valves available in the past have not provided the desired fine control under certain circumstances as may be desired. Also, under adverse conditions such as extremely cold temperatures, fluid-operated valves have had a propensity to be very sluggish, or to not operate at all due to the viscosity of the hydraulic oils.

Other problems encountered in spool valves have been the noise with which they operate, the adverse conditions created in the event of a spring breaking, and the unnecessary complicated nature of the operating mechanisms.

Prior patents illustrate various forms of spool valves, none of which addresses itself to solving such problems and providing the advantages found in the present invention. Such prior patents include Hennells U.S. Pat. No. 3,418,002; Yoshino 4,014,509; Rothrock 3,530,895; Raymond 3,522,817; Kast 3,433,021; Knowles 3,552,442; Mercier 3,563,272; Beckett 3,565,115; Christensen 3,576,194; Kirstein 3,633,871; Roth 3,768,518; Johnson 3,990,477; Kutik 3,508,584; and Hague 3,773,083.

SUMMARY OF THE INVENTION

The spool valve according to the present invention has a generally cylindrical spool in the valve chamber of the housing and slidable along a stationary rod concentric with the spool which forms the anchoring base for dual return springs within the spool and embracing the rod and which act together in restraining movement of the spool and returning the spool to its centered rest position.

The spool has lands to alternately obstruct and open the main exhaust passages of the valve.

Movement of the valve is controlled by application of hydraulic fluid in chambers between the ends of the spool and the housing. Lands at the ends of the spool are slightly spaced from the chamber walls of the housing to define continuously open band orifices around the entire peripheries of the lands at opposite ends of the spool. Accordingly, whenever the pilot or control fluid is under pressure in the chambers at the ends of the spool, there is flow of hydraulic oil through these band orifices. This continual flow of hydraulic oil produces numerous advantages and functional results. The chambers at the ends of the spool which contain the control oil are constantly purged of any air that might otherwise collect in these chambers. There is a constant flow of warm oil so that the control passages of the valve remain operational even in the coldest weather. The constantly flowing oil in the control passages allows a finer control in the shifting of the spool in the valve. The continuous peripheral shape of these band orifices prevents clogging because oil flows around the entire periphery of the end lands of the spool. The continual flow of control fluid allows only a gradual return of the spool to rest position and thereby prevents mechanical shock in the equipment being operated. Furthermore, the continual flow of warm control fluid maintains the valve as a whole in generally heated condition so that the main hydraulic fluid in the main passages continues to be flowable even under the most adverse cold temperature conditions so that the valve remains operational.

Alternatively, the orifices at the ends of the spools to allow continued flow of the control fluid may be located adjacent the inner periphery of the valve spool or adjacent the rod. Instead of a band orifice, under certain circumstances an aperture type orifice endwise through the end land of the spool may be suitable.

The valve spool is reversible in the bore of the housing, and cannot be put in, during servicing, with the wrong orientation.

The valve is a true metering or proportioning hydraulic valve for remote non-mechanical or electrical control.

BRIEF DESCRIPTION OF THE DRAWINGS

FIG. 1 is a diagrammatic view showing the view in one possible relationship to a motor and peripheral hydraulic connections.

FIG. 2 is a longitudinal section view through the valve.

FIG. 3 is an end elevation view of the valve with one of the end covers removed.

DETAILED SPECIFICATION

Figure 4:
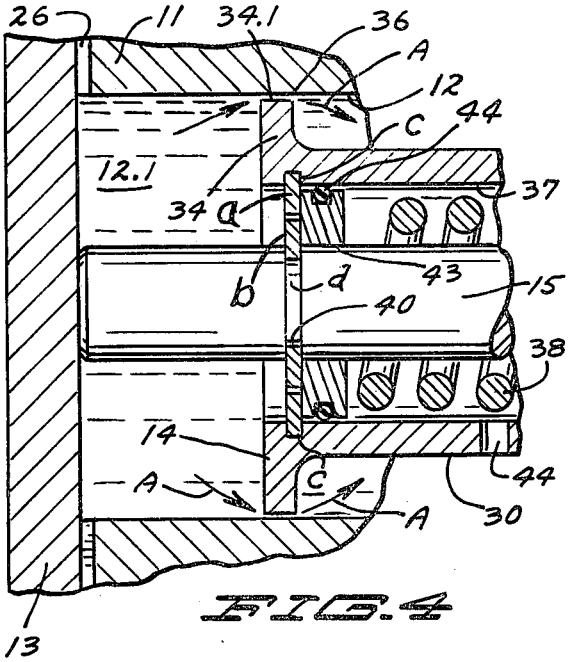
FIG. 4 is an enlarged detail section view at one end of the valve spool.

The hydraulic fluid valve according to the present invention is indicated in general by numeral 10 and has a valve housing 11 with an enlarged interior bore 12, end covers 13 which close and seal the ends of the bore 12, a valve spool 4 in the bore 12, and a spring anchoring rod 15 extending throughout the entire length of the bore. A pair of springs 16 and 17 are arranged in end to end relation with each other and are anchored on the rod 15 and on the spool 14.

The housing 11 is made by precision machining and is provided with a plurality of main hydraulic fluid passages 18, 19, 20, 21 and 22, all of which extend around the entire periphery of the bore 12 and are in communicating relation therewith. The annular passages 18–22 are accordingly connected with annular hydraulic fluid galleries 18.1, 19.1, 20.1, 21.1 and 22.1 which respectively carry the hydraulic fluid to and from the respective passages.

The passage 18 is a pressure passage and accordingly is in open communication with a pressure port 18.2 which extends entirely through the housing 11 from front to back and is threaded at its ends for mounting suitable hydraulic fluid conduit fittings for the purpose of connecting the pressure port 18.2 to a pump 23 or other suitable source of hydraulic fluid pressure.

The passages 19 and 20 are supply and return passages for supplying oil or hydraulic fluid to and from a load or motor 24. Accordingly, the galleries 19.1 and 20.1 communicate with upper and lower threaded ports 19.2, 19.3, 20.2 and 20.3 which are adapted to receive the hydraulic fluid conduit fittings. Dual upper and lower ports are provided in order to connect more than one motor if desired, and may be suitably plugged in the event only one hydraulic motor or device is to be controlled by the valve 10.

Passages 21 and 22 are intended to be connections to the return tank 25, and accordingly the galleries 21.1 and 22.1 are respectively connected to horizontal ports 21.2 and 22.2 which also extend to both front and rear of the housing 11 and are threaded to receive suitable conduit fittings.

It will be recognized that the spacing between the several pressure supply and return passages 18, 19, 20, 21 and 22 are very precise so that the shifting of the spool 14 will facilitate interconnection of these several ports and complete sealing of the ports in various positions of the spool.

In an alternative form, passages 18–22 may not be truly annular, but each such passage will be interrupted by a plurality of narrow bridges, spaced circumferentially from each other, and each of which extends generally endwise of the bore 12 in traversing its respective passage. Such bridges guide the lands of the spool 14 smoothly across the passages and add stability and strength to the housing.

Shifting of the spool 14 is effected by hydraulic fluid pressure in the end chambers 12.1 and 12.2 of the bore, and accordingly, control or pilot fluid passages 26 and 27 are located at the extreme ends of the interior bore, immediately adjacent the end plates 13. The control fluid passages 26 and 27 are generally linear and radially arranged, although they might be annular in a modified form. It will be recognized in FIG. 3 that there are two separate control fluid passages 26 and 26.1 which communicate with the end chamber 12.1, and similarly at the other end, there are two additional control fluid passages 27 and 27.1.

Each of the separate control passages 26, 26.1, 27, 27.1 is connected by interior bores in the housing to exterior ports 26.2, 26.3, 27.2, 27.3 in order to apply control fluid under suitable pressure in the bore. The control ports are connected to suitable valving such as a valve 28 in FIG. 1 by which the pressure at the control passages 26 and 27 may be controlled or reduced in order to effect shifting of the valve spool 14.

The valve spool 14 is generally shaped as a hollow cylinder, formed by extremely precision machining and having a plurality of grooves 29, 30 and 31 formed in the periphery thereof as to define a number of main lands 32 and 33 and a pair of control lands 34 and 35 at the extreme ends of the spool. Spool 14 is symmetrical in end for end relation so that the spool may be reversed or put into the bore 12 in either orientation. In this particular valve arrangement, there are only two main lands 32 and 33 for the purpose of closing and interconnecting various of the passages 18–21, but other main land arrangements may be useful in other arrangements of passages.

It is important to understand that the main lands 32 and 33 are shaped and sized as to have a sealing fit with the interior periphery of bore 12 so as to prevent endwise passage of hydraulic fluid between the lands and the periphery of the bore 12; but the lands 32 and 33 also permit endwise shifting of the spool in the bore. The lands 32 and 33 have radial dimensions approximately one ten-thousandths inch less than the radial dimension of the bore 12. The principal exterior surface of the lands 32 and 33 is cylindrical as to extend along the interior periphery of the bore for a significant distance. It will be seen that end portions of the lands 32 and 33 are also tapered in a conical manner as to obtain suitable control of the main hydraulic fluid in the several passages.

The control lands 34 and 35 separate the grooves 30 and 31 of the spool from the control fluid chambers 12.1 and 12.2 at the opposite ends of the spool. The control lands are substantially identical with each other and in their relation to the interior periphery of the bore 12. As particularly depicted in FIG. 4, the control lands 34 and 35 have an outside diameter which is slightly less than the inner periphery of the bore 12. The space between the outer periphery of lands 34 and 35 and the inner periphery of bore 12 is designated by the numeral 36 and is referred to herein as a band orifice. The band orifice 36 is annular in shape and is continuously open so as to allow continuous flow of the hydraulic control fluid around the land 34, from the control fluid chamber at the end of the spool and into the adjacent tank passage 21, 22. The outer periphery 34.1 of the land 34, and the corresponding outer periphery 35.1 of the land 35, each have a radial dimension which is approximately fifteen-thousandths (0.0015) inches less than the radial dimension of the bore 12. In other words, each of the band orifices 36 has a thickness in a radial direction of fifteen ten-thousandths of an inch.

At typical operating pressures of 250 psi for hydraulic oil in the control system and in the chambers 12.1 and 12.2, the flow of hydraulic oil through the band orifices will amount to approximately 0.4 gallons per minute at operating temperatures. The pressure in the tank passages 21 and 22 is considerably less than the pressure in the control passages 26, 27, and the hydraulic fluid from the control passages is simply returned to the tank.

The spool 14 has a generally cylindrical inner periphery 37, substantially larger than the size of rod 15 which extends through the center of the spool 14. A pair of compression springs 38 and 39 are disposed within the inner periphery of the spool 14 for returning the spool to its centered rest position illustrated in FIG. 2.

In order to permit shifting of the spool 14 in both endwise directions while providing for the return of the spool to centered rest position, three sets of concentric stop rings 40, 41 and 42 are disposed at the several ends of the two springs 38 and 39. Each of the sets 40, 41 and 42 of stop rings are identical with each other and are illustrated in greater detail in FIGS. 3 and 4. Each set has an outer ring a and an inner ring b, which are of suitable size as to accommodate sliding of the ring a with the slide 14 as it shifts in both endwise directions in the bore. Rings a and b are rigid metal snap rings which may be easily affixed into grooves c and d in the adjoining portions of the inner periphery 37 of the valve spool and in the rod 15, respectively. Accordingly, it will be seen that the springs 38 and 39 may not move endwise along rod 15 beyond snap rings b in each of the ring sets 40, 41 and 42 in either direction; and neither may the springs 38 or 39 move endwise with respect to the spool 14 in an endwise direction outwardly beyond the ends thereof.

However, because the stop rings in the several sets 40, 41 and 42 are snap ring and open-ended, as seen clearly in FIG. 3, the stop rings do not provide a seal against passage of hydraulic fluid pressure endwise along the rod 15 and in the ends of spool 14.

At each end of each of the springs 38 and 39, an anchoring and sealing ring 43 bears against the end of the respective spring and fits onto the rod 15 in a sealing, but sliding fit. Each of the rings 43 also has a sealing relationship to the inner periphery of the spool 14, which sealing relationship is provided by a rubber O-ring 44 confined in a suitable groove. The O-ring 44 permits sliding along the inner periphery of the spool, but also provides a hydraulic fluid seal. Accordingly, at the opposite ends of the spool 14, the hydraulic fluid pressure in the chambers 12.1 and 12.2 is obstructed by the rings 43. The spaces occupied by the springs 38 and 39 within the inner periphery of the spool are accordingly at tank pressure as a result of apertures 44 radially through the spool adjacent the lands 32 and 33.

Figure 5:
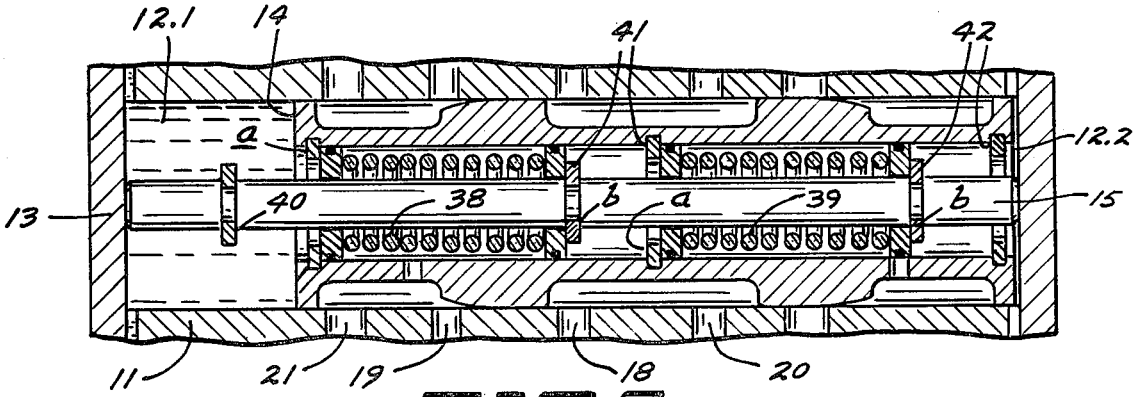
FIG. 5 is a detail section view showing the valve spool in shifted position.

When the spool 14 is shifted endwise as indicated in FIG. 5, to connect the pressure passage 18 with the supply passage 20, and connecting the return passage 19 to the tank passage 21, the top ring b of set 41 retains the spring 38 against endwise movement along the rod 15, and similarly, the ring b of set 42 prevents movement of the spring 39 endwise along the rod 15. Such displacement of the spool causes stop ring a of set 40 to be displaced with the spool 14 and causes the spring 38 to be compressed, and the outer ring a of stop ring set 41 also causes compression of the spring 39. Accordingly, when the pressure differential between control chamber 12.1 and 12.2 is again eliminated, the springs 38 and 39 will cooperate to return the spool 14 to its centered rest position. In a manner similar to that illustrated in FIG. 5, the spool may also move endwise to the left.

Although the valve 10 is capable of several modes of operation, a typical mode of operation contemplates that the pump 23 normally applies the main hydraulic pressure, in the range of 5,000 psi to the pressure port 18.2 and to the passage 18 and groove 29 of the spool. By shifting of the spool in one direction or the other, the main hydraulic pressure is applied through one of the passage 19 or 20 for operating the motor 24, and at the same time the hydraulic fluid returned from the motor 24 will return through the other supply or return passage 19 or 20 to the tank 21 or 22.

In this mode of operation, it is also contemplated that the pump 23 supplies hydraulic fluid under pressure to the reducer valve 45 to the manual control valve 28 which normally supplies a reduced pressure in the range of 250 psi to both of the control ports 26.2 and 27.2, so as to equally pressurize both of the control chambers 12.1 and 12.2. Tank pressure which is nominally atmospheric pressure, but may be as much as 35 psi in a closed system, will be present at the tank passages 21 and 22 and in the end grooves 30, 31 of the spool. Accordingly, there is a significant flow of hydraulic fluid moving continually as indicated by the arrows A in FIG. 4 through the band orifice 36, and such flow of hydraulic fluid is substantially the same through the orifices at both ends of the valve spool. As a result of this constant flow of control hydraulic fluid through the band orifices, the air in the control chambers 12.1 and 12.2 is continually purged, it being recognized that hydraulic fluid or oil which is constantly being pumped will carry a significant amount of air which will accumulate in chambers such as 12.1 and 12.2 unless purged. The continual flow of control fluid through the band orifices also keeps the control fluid in the chambers 12.1 and 12.2 and the related conduits and fittings continuously warm, and this is particularly important where the valve 10 is used in severe climatic conditions for operating hydraulic equipment. The band or annular shape of the orifice 36 prevents any possible clogging of the orifice by reason of contaminating specks or particles which conceivably could obstruct one narrow peripheral segment of the orifice 36, but would be very unlikely to clog the entire periphery of orifice 36. The constant flow of oil through the band orifices 36 also continues to deliver heat to the valve 10 as a whole so as to continually warm the main hydraulic fluid in the pressure port 18.2 and groove 29 so as to maintain the valve 10 ready for instant operation even though severly cold climatic conditions may be encountered. When it is intended to operate the valve 10, the hand control valve 28 may be operated for the purpose of opening one of the control ports such as 27.2 to tank pressure, thereby considerably reducing the hydraulic pressure in control chamber 12.2. Valve 28 may be operated so as to gradually reduce the pressure in chamber 12.2 rather than suddenly dropping the entire pressure in this control chamber 12.2. The continual flow of hydraulic fluid through the band orifice 36 permits a finer degree of control of the pressure in the chamber 12.2 as the pressure at port 27.2 is reduced by operation of the valve 28. When the chamber 12.2 is entirely reduced to tank pressure, which may be in the range of 35 psi, oil will continue to flow through the band orifice 36 to continue the functions hereinbefore described which are brought about by this continual flow of oil.

When the spool 14 is again to be centered to its rest position, the control valve 28 will be operated so as to again increase the pressure at the port 27.2 and in the control chamber 12.2. At this time, as depicted in FIG. 5, the size of the chamber 12.1 is substantially greater than 12.2 and, in order to allow the springs 38 and 39 to return the valve spool to its centered rest position, a portion of the hydraulic fluid in chamber 12.1 must be removed. Although the hydraulic fluid pressure from valve 28 is the same at both ports 26.2 and 27.2 as a result of the pressure received from pump 23, the fluid pressure in chamber 12.1 is substantially greater than the pressure in chamber 12.2 due to the operation of springs 38 and 39 bearing against the valve spool and attempting to return the valve spool to its rest position. This substantial pressure in chamber 12.1 causes continued flow of the control fluid through the band orifice so as to return the excess hydraulic fluid from chamber 12.1 back through the tank passage 21 and to the tank. Soon, but not instantaneously, the valve spool 14 will return to its centered position under influence of the springs 38 and 39 so as to again close passages 19 and 20 from both the pressure and tank passages 18, 21 and 22.

During initial movement of the valve spool, the movement is restrained by both of the springs 38 and 39, and both of the springs contribute materially to the return of the valve spool to its centered rest position. The springs 38 and 39 are individually capable of returning the spool to centered position and of holding the spool at centered position in the event that one of the springs might break. Under this condition where one spring might break, the valve 10 is still fully controllable, although the response is somewhat slower. However, under this condition, there is not likely to be sudden damage to machinery and property, or injury to persons due to failure of a spring.

The rod 15 is centered in the bore 12 by the spool 14 and the sealing rings 43; but end plates 13 do not clamp the ends of the rod so as to restrain movement of the rod in a transverse direction in order to maintain its centered position in the bore.

Figure 6:
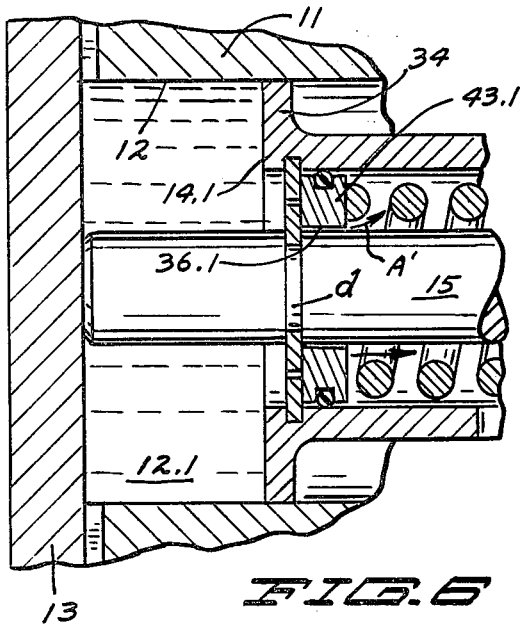
FIG. 6 is an enlarged detail section view showing a modified form.

In the modified form illustrated in FIG. 6, the spool 14.1 is substantially identical to spool 14 of FIGS. 2–5, excepting that the endmost lands 34 have a sealing fit with the bore 12. Instead of the band orifice being located at the outer periphery of lands 34, a band orifice 36.1 is disposed between the rod 15 and the inner periphery of the sealing ring 43.1. In this instance, the inner periphery of ring 43.1 is spaced by approximately fifteen ten-thousandths from the periphery of rod 15 in order to allow the continued flow of oil as indicated by the arrow A'. In this form of the invention illustrated in FIG. 6, the arrangement of the sets of stop rings and the housing are all the same as previously described.

Figure 7:
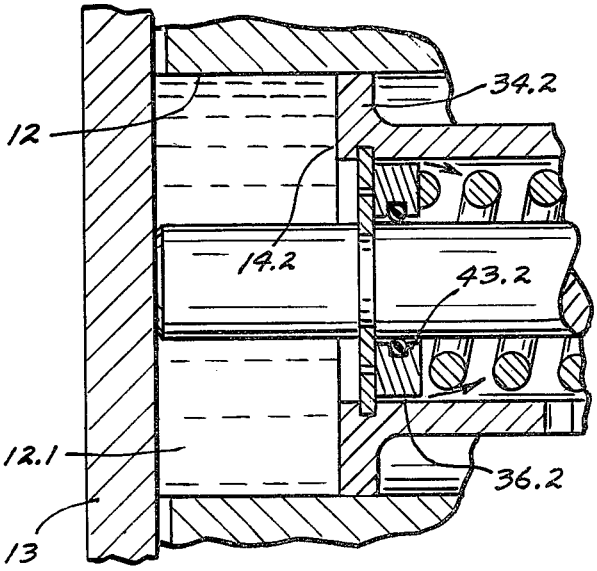
FIG. 7 is an enlarged detail section view showing a second modified form.

In the form of the invention illustrated in FIG. 7, the valve spool 14.2 is identical to the valve spool 14 of FIGS. 2–5 in all respects except that the endmost lands 34.2 have a sealing fit with the inner periphery of bore 12 and do not allow continual flow of hydraulic fluid around the lands 34.2. In this form of the invention the band orifice 36.2 is located between the outer periphery of the sealing ring 43.2 and the inner periphery of the valve spool. The band orifice 36.2 may again be approximately fifteen ten-thousandths in thickness, but extend around the entire periphery of the spool.

The forms illustrated in FIGS. 6 and 7 function substantially the same as the form illustrated in FIGS. 3–5 except that the band orifices 36.1 and 36.2 are located slightly inwardly of the outer periphery of the bore 12 so that any accumulated air pockets in the end chambers are more difficult to purge of air. However, because the hydraulic fluid continually moves in the system, air is extremely unlikely to collect in pockets and the band orifices 36.1 and 36.2 will continue to continually purge the system of oil because they permit continual flow of the control fluid.

Figure 8:
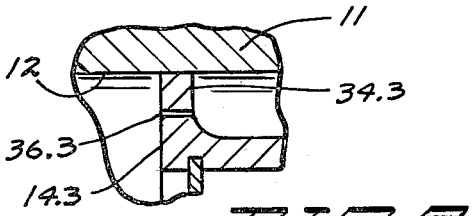
FIG. 8 is an enlarged detail section view, showing another modified form.

In the form of the invention illustrated in FIG. 8, the valve spool 14.3 is substantially identical to that of FIGS. 2–5 excepting that the endmost lands 34.3 have a sealing fit with the periphery of bore 12. In this form of the invention, an aperture orifice 36.3 replaces the band orifices in the other forms of the invention illustrated herein. The function of the aperture orifice 36.3 is substantially identical to that previously described with the possible limitation that the aperture orifice 36.3 might be subject to occasional clogging if contaminants are permitted to exist in the hydraulic fluid used in the control system. Of course, suitable filtering of the hydraulic fluid will minimize such clogging.

Figure 9:
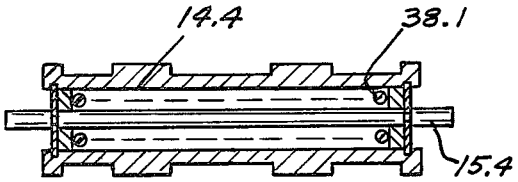
FIG. 9 is a detail section through the valve spool and showing a modified form of spring arrangement.

In the form of the invention illustrated in FIG. 9, the housing is eliminated for simplicity, and the valve spool 14.4 is substantially identical in all respects to the valve spool 14 of FIGS. 2–5 except that the inner peripheral groove for the intermediate set 41 of stop rings is eliminated in FIG. 9. Similarly, the rod 15.4 has its intermediate groove d for the set 41 of stop rings eliminated. Instead of having two separate springs 38 and 39, this form of the invention utilizes only a single spring 38.1, in this event extending the full length of the valve spool for the purpose of returning the spool to its centered rest position when the pressures in the control chambers at the ends of the spool are equalized.

It will be seen that I have provided a new and improved hydraulic fluid spool valve wherein the return spring for the spool is confined entirely within the spool and is anchored on a rod extending endwise through the bore for returning the spool to centered rest position. I have also provided band orifices at the opposite ends of the valve spool, about the outer periphery of the endmost lands, or in other forms at the inner peripheries of the spool at the ends thereof, or as an aperture orifice, to permit continual flow of hydraulic fluid so as to continuously circulate the control fluid for a number of advantages as previously pointed out. The spool is shiftable in both endwise directions, and the stop rings at the ends of the springs are arranged to pass by each other to accommodate endwise movement in both directions.

Other control conditions may be established in connection with the valve 10. Instead of maintaining fluid at control pressures of 250 psi at both ports 26.2 and 27.2, and then relieving one of these pressures in order to produce movement of the spool, the valve may be operated in other modes, such as normally maintaining both control ports 26.2 and 27.2 at substantially nominal pressures of 35 psi. Under these conditions, a control pressure of up to 250 psi may be applied in one of the ports such as 26.2 in order to produce shifting of the spool. If the springs are of such a size as to require a 50 psi differential in pressures between the ports 26.2 and 27.2, then even loss of control pressure in one of the ports would not cause an erroneous operation of the valve because the 35 psi control pressure in the other port would simply not be enough to shift the spool.

What is claimed is:

1. A fluid valve comprising a housing having an interior bore with closed ends and having a plurality of main fluid passages and control fluid passages intersecting and communicating with the interior bore to carry the main flow of fluid and the control fluid into and out of the interior bore, an elongate valve spool in the bore of the housing and having alternate peripheral grooves and lands providing connections between the several passages, the valve spool being longitudinally shiftable in the bore under the influence of the control fluid in the bore and acting against the valve spool, the lands moving along the main fluid passages to change the connections thereto and having a sealing fit with the periphery of the bore, the valve spool having a longitudinal central opening extending entirely throughout the length thereof, an elongate stationary anchor rod in the bore of the housing and bearing endwise against the opposite closed ends of the bore, and the rod extending through the longitudinal opening of the valve spool, a return spring concentric of the rod and disposed within the longitudinal opening of the valve spool, the spring having means connecting opposite ends thereof with the spool and rod for returning the spool to a rest position in the bore.

2. The fluid valve according to claim 1 and said connecting means at the opposite ends of the spring including a pair of concentric inner and outer rings within the inner periphery of the valve spool and embracing the rod, the outer ring being affixed to the valve spool and the inner ring being affixed to the rod, the outer ring being movable with the valve spool to urge the end of the spring longitudinally along the rod.

3. The fluid valve according to claim 2 and there being a second pair of such rings respectively affixed to the valve spool and rod, one pair of said rings being disposed adjacent one end of the spool and rod and the other pair of rings respectively being disposed adjacent the other end of the valve spool and rod, the outer ring of each pair of rings embracing the inner ring and being of such a size as to slide in both directions over the inner ring and along the rod as the valve spool is shifted endwise in the bore.

4. The fluid valve according to claim 3 and there being a pair of coil springs in end-to-end relation within the longitudinal opening of the valve spool and embracing the rod, each spring having an outer end disposed adjacent a respective end of the valve spool and each of the springs also having an inner end disposed adjacent the inner end of the other spring, and a pair of inner and outer rings disposed between said inner ends of said two springs and respectively affixed to the rod and valve spool in concentric and radially spaced relation to each other to allow the outer ring to slide in both directions with the valve spool shifting along the interior bore in both directions.

5. A fluid valve comprising a housing having an interior bore with closed ends and a plurality of supply, return and tank passages intersecting and communicating with the interior bore to carry the main flow of fluid and direct the fluid to the tank from the tank passage, the housing also having a pair of control fluid passages intersecting and communicating with the interior bore and respectively located adjacent opposite ends of the bore, each of the tank passages being located adjacent a control fluid passage and between such control fluid passage and the other supply and return passages, an elongate valve spool in the bore of the housing and having alternate peripheral grooves and lands providing connections between the several passages, the valve spool being longitudinally shiftable in the bore to change the connections between the passages, said lands including main lands and a pair of control lands, the main lands moving along the supply and return passages to change the connections thereto and said main lands having a sealing fit with the periphery of the bore to substantially prevent any leakage of fluid around said main lands, the spool having an open interior extending longitudinally therethrough, an anchor rod extending endwise in the bore and endwise through the interior of the spool and bearing against the housing at both ends of the bore, a pair of end-to-end compression springs embracing the rod and disposed within the interior of the spool, a plurality of pairs of concentric inner and outer rings within the inner periphery of the valve spool and embracing the rod, the outer ring being affixed to the valve spool and the inner ring being affixed to the rod, the outer ring being movable with the valve spool to urge the end of the spring longitudinally along the rod, there being a pair of such inner and outer rings at each end of each of the springs, and a pair of sealing rings within the hollow interior of the spool and respectively disposed at opposite ends of the spool and disposed between the adjacent ends of the spring and said concentric rings, said sealing rings having a sealing fit with the periphery of the rod and with the inner periphery of the spool, and the control lands being disposed adjacent the opposite ends of the bore and being located between respective tank and control fluid passages, each of the control lands having a spaced relation with the bore periphery and defining a continuously open band orifice around the periphery of the bore, the band orifices at opposite ends of the valve spool permitting continuous metered flow of fluid endwise along both ends of the bore and around the control lands and from the control fluid passages to the tank passages.

* * * * *